US008062439B2

(12) United States Patent
Shimizu et al.

(10) Patent No.: US 8,062,439 B2
(45) Date of Patent: Nov. 22, 2011

(54) MAGNESIUM ALLOY PLATE AND METHOD FOR PRODUCTION THEREOF

(75) Inventors: Kenichi Shimizu, Itami (JP); Nozomu Kawabe, Itami (JP); Akira Kishimoto, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 1703 days.

(21) Appl. No.: 10/497,664

(22) PCT Filed: Jun. 3, 2003

(86) PCT No.: PCT/JP03/07051

§ 371 (c)(1),
(2), (4) Date: Jun. 4, 2004

(87) PCT Pub. No.: WO2003/103868

PCT Pub. Date: Dec. 18, 2007

(65) Prior Publication Data

US 2005/0067068 A1 Mar. 31, 2005

(30) Foreign Application Priority Data

Jun. 5, 2002 (JP) ..... 2002-164929
Mar. 27, 2003 (JP) ..... 2003-089223

(51) Int. Cl.
*C22F 1/06* (2006.01)
*C22C 23/00* (2006.01)

(52) U.S. Cl. ..... 148/667; 148/420; 420/408

(58) Field of Classification Search ..... 148/667, 148/420; 420/408

See application file for complete search history.

(56) References Cited

U.S. PATENT DOCUMENTS 5,078,807 A * 1/1992 Chang et al. ..... 419/38

FOREIGN PATENT DOCUMENTS

| | | |
|---|---|---|
| JP | 2-57657 | 2/1990 |
| JP | 2-57658 | 2/1990 |
| JP | 6-81089 | 3/1994 |
| JP | 6-293944 | 10/1994 |
| JP | 7-188826 | 7/1995 |
| JP | 2001-200349 | 7/2001 |

(Continued)

OTHER PUBLICATIONS

"Magnesium Binran." Edited by Magnesium linkal, published on Keikinzoku Kyokal, 1975, pp. 144-146.

(Continued)

*Primary Examiner* — Jessee R. Roe

(74) *Attorney, Agent, or Firm* — McDermott Will & Emery LLP

(57) ABSTRACT

A magnesium alloy sheet having an adequate strength and an excellent bendability is provided along with a method of manufacturing such an alloy sheet. The method comprises, rolling a magnesium alloy sheet through a reduction roll, the alloy thereof containing about 0.1-10.0 mass % of Al and about 0.1-4.0 mass % of Zn, wherein the magnesium alloy sheet has a surface temperature of about 100° C. or below at the time just before it is fed in the reduction roll, and the reduction roll has a surface temperature in the range of about 100° C. to 300° C. Particularly, when executing multipass rolling, at least the last pass is accomplished in non-preheat rolling wherein the magnesium alloy sheet and the reduction roll have specified surface temperatures, respectively.

13 Claims, 4 Drawing Sheets

| Rolling Pass No. | 1 | 2 | 3 | ··· | N-1 | N |
|---|---|---|---|---|---|---|
| | | | | | | |
| Sheet surface temperature before rolling | | | | | ≧100℃ | ≧100℃ |
| Roll surface temperature under rolling | | | | | 100～300℃ | 100～300℃ |
| | | | | | Non-preheat rolling | |

FOREIGN PATENT DOCUMENTS

| | | | |
|---|---|---|---|
| JP | 2001-200349 | A | 7/2001 |
| JP | 2001-294966 | A | 10/2001 |
| JP | 2002-120004 | A | 4/2002 |
| JP | 2002-121657 | A | 4/2002 |
| JP | 2002-126806 | A | 5/2002 |

OTHER PUBLICATIONS

Shimizu, "Magnesium Alloy Rolling and Extrusion Technology." 2001, vol. 71, No. 7, pp. 641-645.

* cited by examiner

Fig. 2

| Rolling Pass No. | 1 | 2 | 3 | ... | N-1 | N |
|---|---|---|---|---|---|---|
| | | | | | | |
| Sheet surface temperature before rolling | | | | | ≧100℃ | ≧100℃ |
| Roll surface temperature under rolling | | | | | 100～300℃ | 100～300℃ |
| | | | | | Non-preheat rolling | |

MAGNESIUM ALLOY PLATE AND METHOD FOR PRODUCTION THEREOF

BACKGROUND OF THE INVENTION

1. Technical Field

The present invention relates to a magnesium alloy sheet and a method of manufacturing the same. More particularly, the present invention relates to a magnesium alloy sheet having a high bendability that which is used for applications requiring cold working or warm working, including press forming, deep drawing, and bending.

2. Prior Art

Heretofore, several techniques associated with magnesium alloys have been disclosed by the prior art, including the Japanese Patent Provisional Publications JP A H02-57657, JP A H02-57658, JP A H06-81089, JP A H06-293944, JP A H07-188826, JP A 2001-200349, JP A 2001-294966, and JP A 2002-121657, for example.

However, such techniques of the prior art have involved a very difficult problem in the workability of magnesium alloy, as will be described in greater detail herein below.

(1) Since magnesium, as a simple substance or its alloy, takes on a hexagonal closest packed crystal structure, it does not provide adequate slip systems required for plastic processing and, particularly, its warm workability is remarkably low at temperatures of 200° C. or below. Therefore, when fabricating a molded product by press forming a magnesium alloy sheet, such a low workability of the magnesium alloy has been a principal factor lowering the working productivity remarkably.

For press forming a magnesium alloy sheet, it is necessary to heat a mold and its associated parts required for pressing at about 200° C. or higher temperatures, because cracks or other failures will occur at ordinary temperatures to render the working very difficult. As a result, the prior art method inevitably requires energy and equipment for heating the mold.

Further, even when warm working is to be done by raising the mold temperature above normal, it is difficult to increase the strain rate (working speed) beyond a certain limit due to surface cracking and other defects occurring under such conditions, and thus it has so far been necessary to use a strain rate lower than a certain level.

(2) Magnesium alloy sheets of the prior art tend to exhibit an inferiority in the bendability that affects most greatly their press formability or cold/hot press formability.

Among wrought magnesium alloys obtained by rolling, those alloys belonging to the ASTM AZ31, AZ61 and the like types are used as materials having the greatest versatility. Although aluminum or other elements contained in such magnesium alloys improve their strength to a certain extent, their ductility and toughness are adversely affected thereby. Generally, in metal materials, as the strength increases, their reduction of area (area reduction), elongation, bendability or deep drawability that are measures indicating their ductility and toughness will decrease.

Although the strength and toughness may be increased by adding alloy elements (or tempers) such as strontium and rare earth metals, it adds up to increase in manufacturing cost. Especially, any extra addition of alloy elements may cause a problem of their irremovability in the phase of recycling that should be promoted socially or industrially from now on, thus bringing about a factor that hinders the recyclability.

(3) Although it is possible to expect in general an improvement of magnesium alloys in toughness by controlling their grains minutely, there is a limit to such grain size refinement, and the bendability which is most important for press formability is not improved above a certain level by such a means as grain size refinement.

Accordingly, a primary object of the present invention is to provide a magnesium alloy sheet that combines an excellent bendability with a sufficient strength and a method of manufacturing such a sheet.

DISCLOSURE OF THE INVENTION

According to the present invention, the above-mentioned object is achieved by particularly specifying the chemical composition and rolling conditions of magnesium alloys or magnesium alloy sheets.

That is to say, the present invention, in one aspect, provides a method of manufacturing a magnesium alloy sheet, comprising rolling a magnesium alloy sheet through a reduction roll, the alloy thereof containing about 0.1-10.0 mass % of Al and about 0.1-4.0 mass % of Zn, wherein the magnesium alloy sheet has a surface temperature of about 100° C. or below at the time just before it is fed in the reduction roll and the reduction roll has a surface temperature in the range of about 100° C. to 300° C.

By subjecting a magnesium alloy sheet having the above-described chemical composition to rolling while maintaining the surface temperature of the magnesium alloy sheet just before it is fed in the reduction roll and that of the reduction roll in specified ranges, respectively, the resultant magnesium alloy sheet can have a sufficient strength and at the same time an excellent bendability. Specifically, the magnesium alloy sheet can have about 250 $N/mm^2$ or greater tensile strength and about 15% or greater elongation. Hereinafter, the rolling process or technique in which the sheet for rolling is held at a surface temperature of about 100° C. or below just before it is subjected to rolling and the reduction roll is heated at its surface temperature in the range of about 100° C. to 300° C. when the sheet is actually rolled through the reduction roll is called a "non-preheat rolling."

According to the present invention, magnesium alloys or their chemical compositions were selected considering the strength and the toughness of the resulting sheets. With respect to Al and Zn, the strength or the toughness of a magnesium alloy sheet tends to decrease if its Al or Zn content falls outside their specified ranges. For the present invention, magnesium alloys belonging to AZ type in the ASTM Code are preferred, for example. In the AZ type, the AZ10 represents magnesium alloys containing 1.0-1.5 mass % of Al, 0.2-0.6 mass % of Zn, 0.2 or more mass % of Mn, 0.1 or less mass % of Cu, 0.1 or less mass % of Si, and 0.4 or less mass % of Ca. The AZ21 represents magnesium alloys containing 1.4-2.6 mass % of Al, 0.5-1.5 mass % of Zn, 0.15-0.35 mass % of Mn, 0.03 or less mass % of Ni, and 0.1 or less mass % of Si. The AZ31 represents magnesium alloys containing 2.5-3.5 mass % of Al, 0.5-1.5 mass % of Zn, 0.15 or more mass % of Mn, 0.10 or less mass % of Cu, 0.10 or less mass % of Si, and 0.04 or less mass % of Ca. The AZ61 represents magnesium alloys containing 5.5-7.2 mass % of Al, 0.4-1.5 mass % of Zn, 0.15-0.35 mass % of Mn, 0.05 or less mass % of Ni, and 0.1 or less mass % of Si. The AZ91 represents magnesium alloys containing 8.1-9.7 mass % of Al, 0.35-1.0 mass % of Zn, 0.13 or more mass % of Mn, 0.1 or less mass % of Cu, 0.03 or less mass % of Ni, and 0.5 or less mass % of Si.

Although the lower limit of the surface temperature of the magnesium alloy sheet just before it is fed in the reduction roll is not particularly specified, ordinary temperatures requiring neither heating nor cooling are preferred in view of improvement in energy efficiency.

On the other hand, reduction roll temperatures lower than 100° C. may cause cracking in the sheet under rolling, occasionally rendering it impossible to continue any normal rolling. Further, if the temperature of the reduction roll is to exceed 300° C., the temperature of the sheet under rolling rises so excessively that the effect of the present invention improving the bendability may not be fully achieved, besides that it becomes necessary to provide a large scale heating device for the reduction roll.

Generally, the rolling process is accomplished in a multi-pass rolling system using a plurality of reduction roll units disposed along the production line. It is preferable that at least the last one pass is done in non-preheat rolling mode out of multiple passes of rolling. By going through the last one pass of rolling in non-preheat mode, the resultant magnesium alloy sheet can have an excellent bendability irrespective of the rolling conditions applied in the preceding passes.

According to the present invention, for the rolling process including one or more non-preheat rolling steps, it is preferred that the total rolling reduction be held in the range of about 5.0% to 30.0%. This is because a sufficient bendability cannot be obtained with a total rolling reduction smaller than 5.0%. Meanwhile, if the total rolling reduction exceeds 30.0%, the sheet under rolling will come under an excessively large strain with a high possibility of undergoing cracking.

The rolling reduction for each pass can be determined by the following formula:

{(Thickness before each rolling pass−Thickness after each rolling pass)/(Thickness before each rolling pass)}×100

The total rolling reduction can be determined by the following formula:

{(Thickness before rolling−Thickness after last rolling step)/(Thickness before rolling)}×100

For non-preheat rolling, the rolling speed is preferably about 1.0 m/min or above. If the rolling speed is below this lower limit, it becomes difficult to achieve advantageous effects unique to the non-preheat rolling due to unnecessarily high temperature rise in the sheet under rolling and/or any change in deformation mechanism contingent to the decrease in strain rate.

It is preferable to use a lubricant for the rolling operation. The use of a lubricant is effective for somewhat improving the bendability of the rolled sheet as well. As the lubricant, any commonly used rolling oils may be employed. For this lubrication, it is preferable to apply the lubricant to the magnesium alloy sheet before the latter is subjected to rolling.

Further, according to the present invention, it is preferred that the magnesium alloy sheet be subjected to solution treatment for at least 1 hour or longer at 350-450° C. before it is subjected to non-preheat rolling. This solution treatment permits the process to remove any residual stress or strain induced in process steps preceding the rolling and to lessen textures created in such preceding steps. Thus, any unexpected cracking, strain or deformation of the magnesium alloy sheet can be prevented from occurring in the succeeding finish rolling step. If the temperature of solution treatment is below 350° C. or if its time is shorter than 1 hour, the residual stress may not be removed sufficiently or the textures may not be lessened adequately by the treatment. Meanwhile, if the solution treatment temperature exceeds 450° C., its effectiveness in removing the residual stress or lessening the textures will be saturated, resulting in that an excess energy is consumed in vain in the solution treatment. The upper limit of the solution treatment time is around 3 hours.

Furthermore, it is preferred that the magnesium alloy sheet be subjected to heat treatment at 100-350° C. after the rolling process. This heat treatment is effective for improving the mechanical properties of the rolled sheet by removing any residual stress or strain induced therein by working. The heat treatment time is preferably in the range of about 5 minutes to 3 hours. If the heat treatment is done at a temperature below 100° C. or for a time shorter than 5 minutes, the recrystallization will not be achieved sufficiently and the strain remains unremoved. Meanwhile, if the temperature of heat treatment is above 350° C. or if its time is longer than 3 hours, the grains will become so coarse or oversized that the rolled magnesium alloy sheet will have an inferior bendability.

In another aspect, the present invention provides a magnesium alloy sheet containing about 0.1-10.0 mass % of Al and about 0.1-4.0 mass % of Zn, wherein the magnesium alloy sheet has about 2 or smaller minimum bending modulus B given by the following formula, where r is a minimum bend radius of punch that permits a test specimen to be bent without undergoing surface cracking in a bending test:

$B=r/t$ ($r$=minimum bend radius, $t$=sheet thickness, in mm)

According to the above-described method of the present invention, a magnesium alloy sheet having a 2 or smaller minimum bending modulus B can be readily obtained. A smaller minimum bending modulus B of a magnesium alloy sheet means that it has a higher bendability.

Besides, a study of a magnesium alloy sheet obtained by the above-described method of the present invention revealed that it has an anisotropy smaller than that of ordinary rolled sheets obtained by the prior art rolling methods. Specifically, the magnesium alloy sheet obtained by the method of the present invention was found to have a smaller r-value, namely plastic strain ratio, or a smaller diffraction peak intensity ratio of (002) plane vs. (101) plane as observed in X-ray diffractometry. Thus, based on those findings, the magnesium alloy sheet according to the present invention is defined as having a specified plastic strain ratio r-value or a peak intensity ratio of (002) plane vs. (101) plane.

That is to say, the present invention provides a magnesium alloy sheet having a plastic strain ratio $r_{90}$-value of about 2.0 or less in a tensile direction perpendicular to the rolling direction and meeting at least one of the following requirements:

1. The sheet having an elongation of about 10% or more in a tensile direction perpendicular to the rolling direction; and
2. The sheet having a ratio $I_{(002)}/I_{(101)}$ smaller than about 10, the $I_{(002)}/I_{(101)}$ being a ratio of diffraction intensities $I_{(002)}$ in (002) plane vs. $I_{(101)}$ in (101) plane as observed in X-ray diffractometry.

In the rolling methods of the prior art, the resultant rolled sheet sometimes have a 2 or smaller plastic strain ratio $r_0$ value in a tensile direction parallel to the rolling direction. In this connection, the inventors have conducted a series of studies to find out that to achieve an improvement in bendability the magnesium alloy sheet preferably has a plastic strain ratio $r_{90}$-value of about 2.0 or less at least in a direction perpendicular to the rolling direction besides a direction parallel thereto. Also, the inventors found that it is preferable to take account of elongation or diffraction peak intensity ratio for improving the bendability more positively. Thus, according to the present invention, the elongation and the diffraction peak intensity ratio are specified besides $r_{90}$-value. For such a magnesium alloy sheet according to the present invention, it is assumed that such a smaller $r_{90}$-value or diffraction peak intensity ratio $I_{(002)}/I_{(101)}$ is effective for decreasing the anisotropy and further improving the bendability. Hence, the above-mentioned minimum bending modulus B can be reduced to 2 or below in the magnesium alloy sheet of the present invention. Such a magnesium alloy sheet of the present invention can be readily produced by the above-described method according to the present invention.

According to the present invention, although the plastic strain ratio $r_{90}$-value is specified as 2.0 or below at least in a tensile direction perpendicular to the rolling direction, the plastic strain ratio r-value can also be 2.0 or smaller in any tensile directions other than that perpendicular to the rolling direction, including for example the plastic strain ratio $r_0$ value in a tensile direction parallel to the rolling direction. Particularly, it is more preferable that the plastic strain ratio $r_0$ value in a tensile direction parallel to the rolling direction be about 1.2 or below. This r-value may be controlled to 2.0 or below by regulating, for example, those requirements specified for the above-described method of the present invention, specifically, the sheet temperature before rolling and the roll surface temperature.

The "plastic strain ratio r-value" as used herein refers to the ratio $d_w/d_t$, namely the ratio of the true strain $d_w$ in the width direction vs. the true strain $d_t$ in the thickness direction obtained in a tensile test of a magnesium alloy sheet where an elongation strain is imparted thereto in the tensile direction. As used herein above, "$r_0$-value" represents a plastic strain ratio of the magnesium alloy sheet when the tensile direction is parallel to the rolling direction, while "$r_{90}$-value" represents its plastic strain ratio when the tensile direction is perpendicular to the rolling direction. These plastic strain ratio r-values may be determined in accordance with "Test method for Plastic Strain Ratios of Sheet Metal materials" subject to JIS Z 2254 or in accordance with ASTM E517, for example. More specifically, as shown in FIG. 4, a tensile stress is exerted to a sheet specimen 40 in a direction parallel to the rolling direction to determine a true strain $d_w$ in the width direction and a true strain $d_t$ in the thickness direction, respectively, and then to determine an $r_0$-value therefrom as their ratio $d_w/d_t$. Likewise, a tensile stress is exerted to the sheet specimen 40 in a direction perpendicularly to the rolling direction to determine a true strain $d_w$, in the width direction and a true strain $d_t$ in the thickness direction and then to determine an $r_{90}$-value therefrom as their ratio $d_w/d_t$.

Further, according to the present invention, the magnesium alloy sheet has a diffraction peak intensity ratio $I_{(002)}/I_{(101)}$ below about 10. With a 10 or greater diffraction peak intensity ratio $I_{(002)}/I_{(101)}$, it is difficult to achieve an improvement in bendability. Particularly preferably, the diffraction peak intensity ratio $I_{(002)}/I_{(101)}$ is less than 5.0. The diffraction peak intensity ratio $I_{(002)}/I_{(101)}$ may be controlled to a value below 10, for example, by regulating those requirements specified for the above-described method of the present invention, specifically the sheet temperature before rolling and the roll surface temperature, or by controlling the total rolling reduction (or average rolling reduction). More specifically, since any increase in rolling amount, namely increase in total rolling reduction tends to cause the diffraction peak intensity ratio to increase, it is preferred that a magnesium alloy sheet have a total rolling reduction of 30% or less according to the present invention. Meanwhile, the above-mentioned r-value has a high correlation with this diffraction peak intensity ratio $I_{(002)}/I_{(101)}$, in which a smaller r-value generally tends toward a smaller $I_{(002)}/I_{(101)}$. While the r-value represents a factor that is not significantly subject to the above-described heat treatment after rolling, the diffraction peak intensity ratio is a factor tending to decrease subject to that heat treatment.

Yet further, according to the present invention, the magnesium alloy sheet has an elongation (total elongation after fracture) not smaller than about 10%. With an elongation smaller than 10%, it will become difficult to positively achieve an improvement in bendability even if $r_{90}$-value is 2.0 or less. More preferably, the elongation is 13% or above. The magnesium alloy sheet may have an improved elongation, for example, by refining its grains to some extent and then subjecting it to a proper heat treatment to remove its strain.

Finally, by providing the magnesium alloy sheet with grains having an about 10 μm (micrometers) or smaller average grain size, its bendability will be improved. More preferably, the average grain size is about 7 μm or smaller. The average grain size may be determined by using a formula subject to JIS G 0551, for example. The average grain size may be controlled to be 10 μm or below, particularly 7 μm or below, for example, by adjusting the balance of the dynamic recovery from strain induced in rolling and the above-described heat treatment after rolling, if such a heat treatment is to be applied.

BRIEF DESCRIPTION OF THE DRAWINGS

FIG. 2 is a diagram schematically illustrating a series of states of a magnesium alloy sheet under rolling according to the present invention;

BEST MODE FOR CARRYING OUT THE INVENTION

Figure 1:
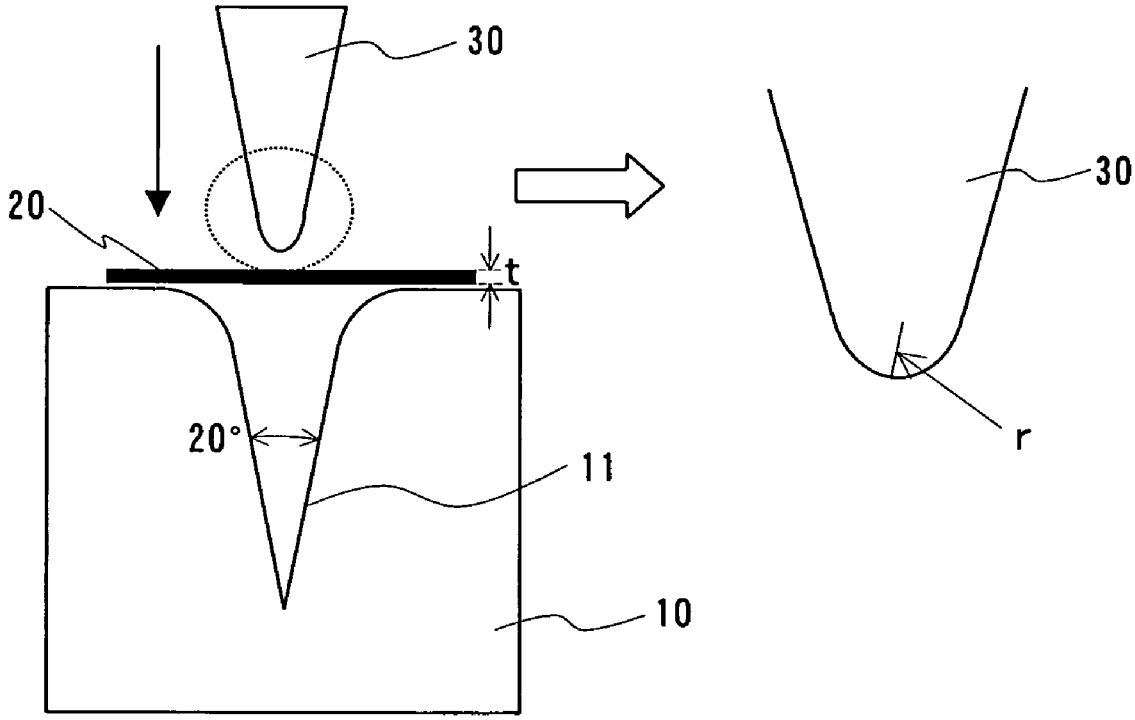
FIG. 1 is a schematic diagram illustrating a bending test.

Hereinafter, the present invention will be described in greater detail based on the preferred embodiments thereof represented by the following experimental examples.

Experimental Example 1

Magnesium alloy sheets were produced through a rolling process, and their tensile properties and bending properties were determined for evaluation.

<Selection of Alloy>

A magnesium alloy belonging to the ASTM AZ31 type was selected as a material to be worked through rolling. This magnesium alloy of AZ31 type contained 3.06 mass % of Al, 0.90 mass % of Zn, 0.01 mass % of Si and 0.57 mass % of Mn with the balance comprising Mg and unavoidable impurities.

<Solution Treatment of Magnesium Alloy>

Before entering the finish rolling step, the magnesium alloy of the above-described AZ31 type was provided in the form of rolled sheets 12 mm, 8 mm and 6 mm thick, respectively, and those sheets were subjected to a solution treatment for 1 hour at 400° C. The purpose of this process is to remove residual stress or strain induced in the preceding working and to lessen textures created in such working. This solution treatment effectively prevented the magnesium alloy sheets from undergoing unexpected cracking, strain or deformation in the succeeding finish rolling step.

<Rolling>

To roll the magnesium alloy into sheets, was used a reduction roll equipment provided with a heating device that could heat both the upper and lower rolls to permit warm rolling. The heater allowed the reduction roll to be heated to its surface temperature of about 200° C.

The respective magnesium alloy sheets having the above-mentioned 3 thicknesses were subjected to rolling by independently varying the following items, respectively, as shown in Table 1: (1) sheet temperature before rolling; (2) roll surface temperature; (3) rolling speed; (4) lubrication; (5) rolling reduction per pass: ({(Thickness before each rolling pass−Thickness after each rolling pass)/Thickness before each rolling pass}×100); and (6) total rolling reduction:({(Thickness before rolling−Thickness after last rolling step)/Thickness before rolling}×100).

The rolling was accomplished in multipass mode using one unit of reduction roll (single stand) provided with a heating device. After each pass, the rolled sheet was subjected to rapid cooling and then just before rolling in the succeeding pass the sheet was heated to its target temperature. The temperatures in the range of 20-25° C. shown under the "sheet temperature before rolling" in Table 1 all denote that the sheets were rolled at the then room temperatures without heating before rolling. For lubrication, an ordinary rolling lubricant was used by applying it to each magnesium alloy sheet before rolling to reduce friction between the rolls and the sheet under rolling.

In most rolling experiments of which results are summarized in Table 1, the same sheet temperature before rolling and the same roll surface temperature during rolling were applied in all of multiple passes. As an exception, in the experiment No.1-16, the sheet was heated to 150° C. just before rolling in all passes but the last one in which the sheet was at a room temperature just before it was fed in the reduction roll. In the experiment No.1-16, the roll surface temperature was set at 179° C. in all passes. The last pass of the experiment No.1-16 was done with the rolling reduction of 5.1%.

<Heat Treatment>

The resultant rolled sheets were subjected to annealing for 15 minutes in a heating furnace at 100-350° C. to improve their mechanical properties by removing residual stress or strain induced therein in the preceding working. As described below, for the rolled sheet specimens in the respective experiments, optimal annealing conditions were determined based on evaluation of their highest tensile strength (TS) and bendability achieved, and such optimal annealing conditions were regarded as providing characteristic values of the specimens representing the magnesium alloy sheets according to the present invention.

<Evaluation>

After the rolling and annealing described above, the rolled sheet specimens were evaluated for their mechanical properties, including the tensile properties and bending properties, as shown in Table 2 below. The tensile properties included the tensile strength (TS) and elongation observed in a tensile test, while bending properties included the minimum bend radius that was determined based on whether surface cracking was observed or not in a bending test.

The bending test was performed using the V-block method subject to JIS Z 2248. The V-block used had a configuration as schematically shown in FIG. 1. A specimen 20 is placed on the V-block 10 which was provided with a V-groove 11 having a vertex angle of 20° in its cross-sectional isosceles, and using a punch 30 having generally the same profile as the V-groove profile the specimen 20 was forced downward into the V-groove 11 so that the specimen 20 had its underside aligned on the wall surface of the V-groove. In so doing, different punches with varied radii of curvature at their tips (r=1.0-3.0 mm) were used as changed in sequence from a punch with the largest radius of curvature to ones with smaller radii. That is, after each bending, the specimen was removed and the outer radius of its bend was inspected for cracking. The test results are shown in Table 2, with "○" denoting a successful bending test without cracking in the specimen surface, while "x" denoting a test failure with cracking observed in the specimen surface.

As a measure of bendability, the minimum bending modulus B determined by the following formula was employed as its typical characteristic value, where r is a minimum bend radius of each punch that permits a test specimen to be bent without undergoing surface cracking in a bending test.

$$B=r/t\ (r=\text{minimum bend radius}, t=\text{sheet thickness, in mm})$$

This minimum bending modulus B was evaluated only in successful bending tests not involving surface cracking, but it was not evaluated in those tests involving surface cracking (experiment indicated by "x" in Table 2). A smaller minimum bending modulus B of a magnesium alloy sheet means that it has a higher bendability. Besides, when a specimen was tested more than once using the same combination of punches of different tip radii of curvature, the smallest value of minimum bending modulus B observed was adopted for that specimen.

TABLE 1

| | Rolling conditions | | | | | | |
|---|---|---|---|---|---|---|---|
| No. | Initial thickness (mm) | Sheet temperature before rolling (° C.) | Roll surface temperature (° C.) | rolling speed (m/min) | Lubricant | Rolling reduction/ pass (%) | Total rolling reduction (%) |
| 1-1 | 1.2 | 190 | 90 | 3.0 | Not used. | 7.3 | 56.2 |
| 1-2 | 1.2 | 180 | 95 | 3.0 | " | 7.0 | 42.3 |
| 1-3 | 1.2 | 350 | 93 | 3.0 | " | 5.5 | 41.6 |
| 1-4 | 1.2 | 170 | 185 | 3.0 | " | 4.2 | 35.9 |
| 1-5 | 0.6 | 135 | 90 | 3.0 | " | 4.1 | 15.2 |
| 1-6 | 0.8 | 170 | 178 | 3.0 | " | 4.7 | 27.0 |
| 1-7 | 0.8 | 220 | 177 | 3.0 | Used. | 10.7 | 27.1 |
| 1-8 | 0.6 | 300 | 173 | 3.0 | " | 8.0 | 19.1 |
| 1-9 | 0.6 | 150 | 188 | 3.0 | " | 6.4 | 19.1 |
| 1-10 | 0.7 | 60 | 186 | 3.0 | " | 5.0 | 28.6 |
| 1-11 | 0.6 | 20 | 187 | 3.0 | " | 3.5 | 15.4 |
| 1-12 | 0.6 | 20 | 185 | 12.0 | " | 2.9 | 13.6 |
| 1-13 | 0.6 | 20 | 185 | 21.0 | " | 2.7 | 12.3 |
| 1-14 | 0.7 | 20 | 180 | 3.0 | " | 4.7 | 28.2 |
| 1-15 | 0.6 | 25 | 182 | 3.0 | " | 3.2 | 15.8 |

TABLE 1-continued

| Rolling conditions | | | | | | | |
|---|---|---|---|---|---|---|---|
| No. | Initial thickness (mm) | Sheet temperature before rolling (° C.) | Roll surface temperature (° C.) | rolling speed (m/min) | Lubricant | Rolling reduction/ pass (%) | Total rolling reduction (%) |
| 1-16 | 0.6 | 150 (25 for last pass) | 179 | 3.0 | " | 3.5 (5.1 for last pass) | 14.5 |
| 1-17 | 0.59 | 25 | 185 | 3.0 | " | 4.5 | 4.0 |
| 1-18 | 0.6 | 25 | 95 | 3.0 | " | 4.8 | 16.7 |
| 1-19 | 0.6 | 150 (25 for last pass) | 179 | 3.0 | Not used. | 3.5 (5.1 for last pass) | 14.5 |

TABLE 2

| Mechanical properties of rolled sheets | | | | | | |
|---|---|---|---|---|---|---|
| | Heat treatment | | | Bendability | | |
| No. | temperature (° C.) | TS (N/mm$^2$) | Elongation (%) | Bend radius r (mm) | Surface cracking | B = r/t |
| 1-1 | 150 | 258.2 | 5.3 | r = 2 | X | 5.71 |
| | | | | r = 3 | ○ | |
| 1-2 | 200 | 187.5 | 1.6 | r = 2 | X | 4.33 |
| | | | | r = 3 | ○ | |
| 1-3 | 300 | 252.9 | 8.5 | r = 2 | X | 4.28 |
| | | | | r = 3 | ○ | |
| 1-4 | 300 | 264.7 | 10.8 | r = 2 | X | 3.90 |
| | | | | r = 3 | ○ | |
| 1-5 | 250 | 261.9 | 19.2 | r = 1 | X | 3.93 |
| | | | | r = 2 | ○ | |
| 1-6 | 300 | 265.9 | 17.6 | r = 2 | X | 5.14 |
| | | | | r = 3 | ○ | |
| 1-7 | 250 | 269.5 | 20.0 | r = 1 | X | 3.43 |
| | | | | r = 2 | ○ | |
| 1-8 | 250 | 265.2 | 12.7 | r = 1 | X | 3.09 |
| | | | | r = 1.5 | ○ | |
| 1-9 | 250 | 257.8 | 18.4 | r = 1 | X | 4.12 |
| | | | | r = 2 | ○ | |
| 1-10 | 250 | 289.9 | 18.2 | r = 1 | ○ | 2.0 |
| | | | | r = 1.5 | ○ | |
| 1-11 | 300 | 292.5 | 16.4 | r = 1 | ○ | 1.97 |
| | | | | r = 2 | ○ | |
| 1-12 | 300 | 262.6 | 22.4 | r = 1 | ○ | 1.93 |
| | | | | r = 2 | ○ | |
| 1-13 | 300 | 252.6 | 21.8 | r = 1 | ○ | 1.90 |
| | | | | r = 2 | ○ | |
| 1-14 | 300 | 277.8 | 16.0 | r = 1 | ○ | 1.99 |
| | | | | r = 1.5 | ○ | |
| 1-15 | 350 | 259.5 | 17.1 | r = 2 | ○ | 1.98 |
| | | | | r = 2 | ○ | |
| 1-16 | 300 | 253.4 | 18.9 | r = 1 | ○ | 1.95 |
| | | | | r = 2 | ○ | |
| 1-17 | 300 | 283.1 | 15.4 | r = 1 | X | 3.53 |
| | | | | r = 2 | ○ | |
| 1-18 | 250 | 151.5 | 0.7 | r = 2 | X | — |
| | | | | r = 3 | X | |
| 1-19 | 300 | 231.4 | 9.4 | r = 1 | X | 2.0 |
| | | | | r = 2 | ○ | |

<Effects of Rolling Conditions>

(Sheet Temperature Before Rolling and Roll Surface Temperature)

As can be understood from the results shown Tables 1 and 2, all experiments where the magnesium alloy sheets were heated at above 100° C. before rolling (experiments No.1-1 through No.1-9) resulted in inferior bendability with a minimum bending modulus B significantly exceeding the lower limit according to the present invention, as compared with those other experiments in which the magnesium alloy sheets were not heated at above 100° C. before rolling but the roll surface was heated to 100° C. or above. Specifically, although those specimens heated to temperatures above 100° C. before rolling showed a 2.0 or above minimum bending modulus B, those specimens having sheet temperatures of 100° C. or below before rolling and rolled at 100° C. or higher roll surface temperatures showed 2.0 or lower minimum bending modulus B. Thus, it can be said that the magnesium alloy sheet preferably have a temperature of 100° C. or below before rolling.

Besides, it is also understood that the roll is heated preferably at a surface temperature of 100° C. or above. If the roll temperature is lower than 100° C., the sheet under rolling will undergo cracking, rendering it impossible to accomplish normal rolling, as in the experiment No. 1-18, for example. It is also preferred that the roll temperature be kept 300° C. or below as its upper limit. This is because if the surface temperature of the reduction roll is to exceed 300° C., the temperature of the magnesium alloy sheet under rolling rises so excessively that the effect of the present invention improving the bendability may not be fully achieved, besides that it becomes necessary to provide a large scale heating device for the reduction roll.

Consequently, it turns out that the rolling conditions for improving bendability comprises limiting the surface temperature of the sheet to 100° C. or below before rolling (just before it is subjected to rolling) and heating the reduction roll to its surface temperature in the range of 100° C. to 300° C. when the sheet is actually rolled therethrough. The above-described rolling condition is called a "non-preheat rolling."

(Lubricant)

When comparing the experiments using a lubricant with those without a lubricant based on the results given in Tables 1 and 2, it will be clearly understood that the use of such a lubricant yields a more significantly improved bendability.

(Rolling Speed)

As shown by the results given in Table 2, a higher rolling speed leads to more or less a smaller value of minimum bending modulus B. That is, it turns out that the bendability improves with the increase in rolling speed.

(Rolling Reduction and Rolling Pass Schedule)

As to how the rolling reduction affects the properties of rolled magnesium alloy sheets, the minimum bending modulus B representing their bendability cannot be decreased to 2.0 even by applying the non-preheat rolling, if the total rolling reduction is below 5.0%, as in the experiment No.1-17. Thus, the total rolling reduction in a process involving the non-preheat rolling is preferably at least 5.0% or above. However, since the average rolling reduction (or rolling reduction for each pass) does not considerably affect the bendability, it may be any ratio provided that the total rolling reduction is at least 5.0% or above.

Particularly, it is to be noted here based on the results given in Tables 1 and 2 that in order for the non-preheat rolling to be effective the non-preheat rolling does not necessarily has to be executed through all rolling passes, but it is sufficient to apply the non-preheat rolling only in the last pass as in the example No.1-16 to achieve an expected improvement in bendability. Nevertheless, in such a case, the rolling reduction of the last pass needs to be 5.0% or above.

For the rolling process including one or more non-preheat rolling steps, the total rolling reduction is preferably 30.0% or less. This is because if the total rolling reduction exceeds 30.0% the sheet under rolling will come under an excessively large strain with a high possibility of undergoing cracking.

Hereinafter, preferable rolling conditions for improving the bendability will be described with reference to the schematic diagram of FIG. 2. FIG. 2 illustrates a case where the non-preheat rolling was performed in the last pass and the pass just prior thereto. Thus, according to the present invention, the rolling conditions involve multiple rolling passes, in which at least one pass including the last one is executed in non-preheat rolling mode. In this case, the rolling conditions for passes preceding the non-preheat rolling pass are not particularly limited. For the rolling process involving one or more non-preheat rolling passes, it is preferred that the total rolling reduction be held in the range of about 5.0% to 30.0%. Further, for the rolling process involving this non-preheat rolling pass, it is preferred that a lubricant is applied to the sheet before rolling and that the rolling speed be about 1.0 m/min or above If the rolling speed is below this lower limit, it becomes difficult to achieve advantageous effects unique to the non-preheat rolling due to unnecessarily high temperature rise in the sheet under rolling and/or any change in deformation mechanism contingent to the decrease in strain rate.

<Measurement of Grain Size>

After evaluating the mechanical properties as above, the respective specimens were observed microscopically for their microstructures and the grain sizes were measured based on microstructural pictures obtained. The observation revealed that the specimens shown in Table 2 all consisted of grains substantially in the range of 5-15 μm, falling into a class of fine grain.

Experimental Example 2

Magnesium alloy sheets were produced through a rolling process, and their tensile properties and bending properties were determined for evaluation.

<Selection of Alloy>

Similarly to the experimental example 1 above, was selected a magnesium alloy belonging to the ASTM AZ31 type (containing 3.06 mass % of Al, 0.90 mass % of Zn, 0.01 mass % of Si and 0.57 mass % of Mn with the balance comprising Mg and unavoidable impurities).

<Solution Treatment of Magnesium Alloy>

In the same manner as in the experimental example 1 above, before entering the finish rolling step, the magnesium alloy of the above-described AZ31 type was provided in the form of rolled sheets 12 mm, 8 mm and 6 mm thick, respectively, and those sheets were subjected to a solution treatment for 1 hour at 400° C. in order to remove residual stress or strain induced in the preceding working and to lessen textures created in such working.

<Rolling>

As in the experimental example 1 above, to finish roll the magnesium alloy into sheets, was used a reduction roll equipment provided with a heating device that could heat both the upper and lower rolls to their surface temperatures of about 200° C.

In the similar manner as in the experimental example 1 above, the rolling was accomplished in multipass mode using one unit of reduction roll (single stand) provided with a heating device. After each pass, the rolled sheet was subjected to rapid cooling and then just before rolling in the succeeding pass the sheet was heated to its target temperature. Further, an ordinary rolling lubricant was applied to each specimen before rolling (indicated as "Used." under the item "Lubricant" in Table 3). The specimens No. 2-1 and 2-2 were subjected to non-preheat rolling. The specimens No. 2-3 through 2-8 were rolled under the conditions shown in Table 3. Similarly to the experimental example 1 above, the same sheet temperature before rolling and the same roll surface temperature during rolling were applied in all of multiple passes.

<Heat Treatment>

As in the experimental example 1 above, the resultant rolled sheets were subjected to annealing for 15 minutes in a heating furnace at 100-350° C. For the rolled sheet specimens in the respective experiments, optimal annealing conditions were determined based on evaluation of their highest tensile strength (TS) and bendability achieved, and such optimal annealing conditions were regarded as providing characteristic values of the specimens representing the magnesium alloy sheets according to the present invention. Table 3 shows the rolling conditions of the experimental example 2, including the initial thickness, sheet temperature before rolling, roll surface temperature, rolling reduction for each pass, and total rolling reduction. The rolling reduction for each pass and the total rolling reduction were determined in the same manner as in the experimental example 1.

TABLE 3

| Rolling conditions | | | | | | | |
|---|---|---|---|---|---|---|---|
| No. | Initial thickness (mm) | Sheet temperature before rolling (° C.) | Roll surface temperature (° C.) | Rolling speed (m/min) | Lubricant | Rolling reduction/pass (%) | Total rolling reduction (%) |
| 2-1 | 0.6 | 20 | 120 | 3.0 | Used. | 2.8 | 16.0 |
| 2-2 | 0.6 | 20 | 110 | 3.0 | " | 2.3 | 16.2 |
| 2-3 | 0.6 | 250 | 175 | 3.0 | " | 4.2 | 16.0 |
| 2-4 | 0.8 | 150 | 175 | 3.0 | " | 3.8 | 37.0 |
| 2-5 | 0.8 | 300 | 180 | 3.0 | " | 5.1 | 25.0 |
| 2-6 | 0.8 | 200 | 178 | 3.0 | " | 4.5 | 25.0 |
| 2-7 | 0.59 | 150 | 179 | 3.0 | " | 3.1 | 14.2 |
| 2-8 | 1.2 | 150 | 183 | 3.0 | " | 4.9 | 57.8 |

<Evaluation>

After the rolling and annealing described above, the rolled sheet specimens were evaluated for their properties. For this evaluation, the r-value, X-ray diffraction peak intensity ratio, average grain size, tensile strength (TS), and total elongation after fracture (elongation) were measured. Also, the respective specimens were subjected to V-block type bending test according to JIS Z 2248, like the experimental example 1 above. Besides, the minimum bending modulus B was determined using different punches with varied radii of curvature at their tips. The results of the experiments are shown in Table 4. The minimum bend radius shown in Table 4 denotes the smallest value permitting the specimen to bend without undergoing surface cracking.

<<R-Value>>

Figure 4:
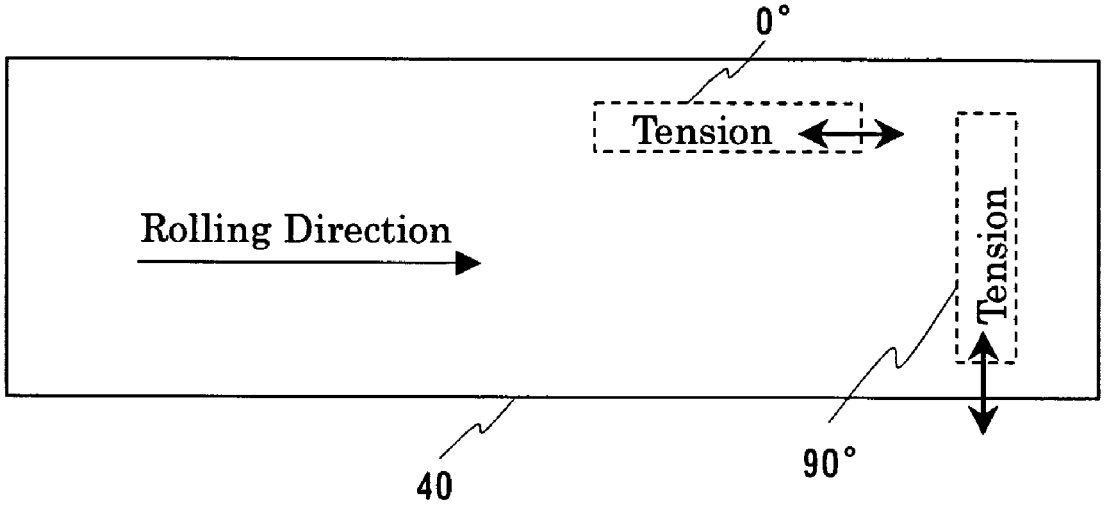
FIG. 4 is a schematic diagram illustrating a tensile stress applied to a sheet specimen.

The plastic strain ratio r-values were determined in accordance with "Test method for Plastic Strain Ratios of Sheet Metal materials" subject to JIS Z 2254. Tensile directions for evaluation included a direction parallel to the rolling direction of the alloy sheet (indicated as 0° in Table 4) and a direction perpendicular to the rolling direction (shown as 90° in Table 4) (See FIG. 4). Moreover, in this experiment, the respective r-values were calculated using r-values at predetermined elongations. Specifically, r-values at 5-10% elongations were determined beforehand, and average values obtained by using those r-values were regarded as r-values at specific elongations measured. For example, for a 12% elongation, the average of the r-values at 5% and 12% elongations was used as the r-value thereat, while for an elongation smaller than 5% the average of an r-value at a 5% elongation and an r-value at an elongation just before fracture was used as the r-value at such elongation smaller than 5%.

<<X-Ray Diffraction Peak Intensity Ratio>>

Figure 3:
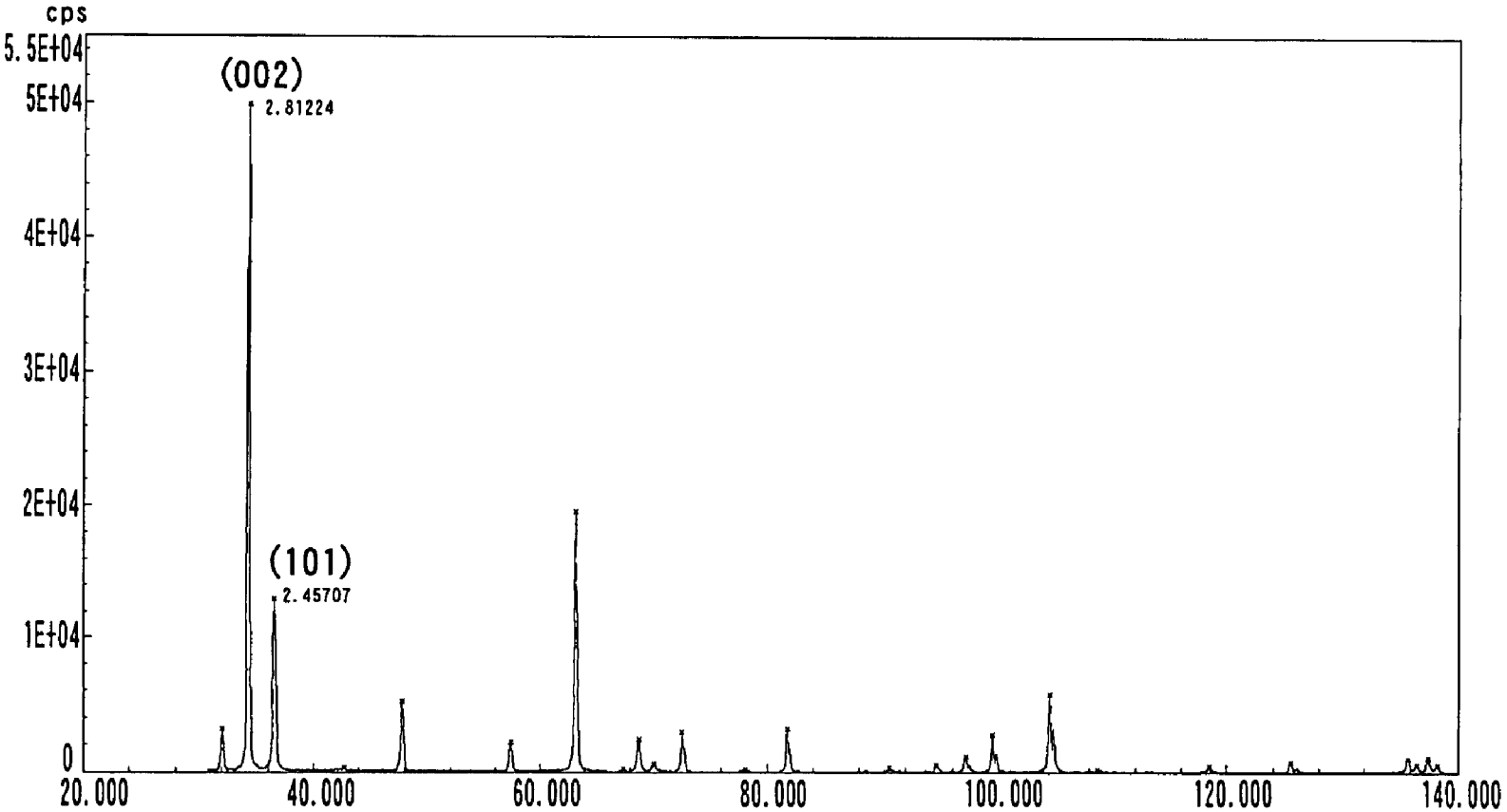
FIG. 3 is a graph showing an X-ray diffraction intensity observed in a preferred embodiment of the magnesium alloy sheet according to the present invention.

The resultant respective magnesium alloy sheet specimens were subjected to X-ray diffractometry test to determine the diffraction peak intensities in (002) plane in (101) plane, respectively. FIG. 3 is a graph showing the X-ray diffraction intensity observed in the specimen No.2-1. Then, the ratio $I_{(002)}/I_{(101)}$ of diffraction peak intensity in I (002) plane vs. diffraction peak intensity in (101) plane was determined. The X ray diffractometry was performed under the following conditions:

X-ray used: Cu—Ka

Excitation conditions: 50 kV 200 mA

Measurement method: θ-2θ method

<<Average Grain Size>>

The average grain size was determined using a formula therefor ($d_m=1/\sqrt{m}$, $d_m$: average grain size, m: the number of grains per 1 $mm^2$ surface area of specimen) subject to Annex 3 to JIS G 0551.

<<Elongation>>

Based on JIS Z 2241, the total elongation after fracture was determined for each specimen for evaluation of the present invention.

TABLE 4

| | r-value | | Diffraction peak intensity ratio | Average grain size | TS | Elongation (%) | | Bending properties: Min. bend radius | Bending properties: Min. bending modulus B |
|---|---|---|---|---|---|---|---|---|---|
| No. | 0° | 90° | $I_{(002)}/I_{(101)}$ | (μm) | ($N/mm^2$) | 0° | 90° | (mm) | |
| 2-1 | 1.2 | 2.0 | 4.0 | 4.7 | 258 | 16.8 | 15.6 | 1.0 | 1.98 |
| 2-2 | 1.0 | 1.9 | 3.8 | 5.7 | 273 | 14.3 | 17.7 | 1.0 | 1.99 |
| 2-3 | 1.7 | 4.4 | 8.2 | 5.1 | 275 | 16.3 | 20.2 | 1.5 | 2.98 |
| 2-4 | 1.6 | 2.3 | 11.2 | 5.3 | 264 | 12.9 | 21.0 | 2.0 | 3.97 |
| 2-5 | 2.2 | 3.2 | 7.1 | 10.2 | 218 | 4.6 | 3.6 | 3.0 | 5.0 |
| 2-6 | 2.0 | 3.5 | 5.1 | 6.2 | 241 | 6.3 | 3.8 | 2.5 | 4.17 |
| 2-7 | 1.3 | 3.3 | 4.7 | 6.1 | 265 | 15.1 | 15.6 | 2.0 | 3.95 |
| 2-8 | 1.4 | 1.6 | 15.1 | 12.8 | 207 | 8.9 | 9.9 | 2.0 | 3.94 |

As shown in Tables 3 and 4, it turns out that the specimens No.2-1 and 2-2 which were subjected to non-preheat rolling has a smaller anisotropy or, more specifically, they show a plastic strain ratio r-value of 2.0 or less not only in the tensile direction parallel to the rolling direction but in the tensile direction perpendicular to the rolling direction. Besides, it turns out that these specimens have such a small diffraction peak intensity ratios $I_{(002)}/I_{(101)}$ as below 10. In addition, these specimens have a 10% or higher elongation both in the tensile direction parallel to the rolling direction and in the tensile direction perpendicular to the rolling direction. Thus, it is understood that the specimens No.2-1 and 2-2 which were subjected to non-preheat rolling have a small anisotropy, and a high elongation, yielding an excellent bendability with a minimum bending modulus B as small as 2.0 or less.

On the other hand, even if satisfying at least one requirement of either a diffraction peak intensity ratios $I_{(002)}/I_{(101)}$ smaller than 10 or a 10% or higher elongation, the specimens No.2-3 through 2-7 which were not subjected to non-preheat rolling all showed a minimum bending modulus B above 2.0 with a plastic strain ratio $r_{90}$-value above 2.0 and as a result had a lower bendability as compared with the specimens No.2-1 and 2-2 subjected to non-preheat rolling.

Although the specimen No.2-8 has a smaller $r_0$-value and $r_{90}$-value, it turned out that the specimen No.2-8 is inferior in bendability to the specimens No.2-1 and 2-2 subjected to non-preheat rolling because it had a minimum bending modulus B greater than 2.0 with an elongation below 10%. Moreover, the specimens No.2-1 and 2-2 had their total rolling reduction restricted to 30% or below and were subjected to heat treatment proper for strains occurred during rolling to control the average grain size to 10 μm or below, while in the specimen No.2-8 the average grain size was not controlled and larger grains resulted. Therefore, it is understood that for achieving a more positive improvement in bendability the average grain size should preferably be taken into consideration.

Further, a magnesium alloy sheet was prepared in the same manner as in the specimen No.2-1 and its plastic strain ratio $r_{45}$-value in a tensile direction at a 45° angle to the rolling direction was determined to be 2.0 or less. Thus, non-preheat rolling according to the present invention is effective for reducing the plastic strain ratio r-value in all tensile directions and minimizing the anisotropy to contribute to improvement in bendability of the magnesium alloy sheet.

INDUSTRIAL APPLICABILITY

As fully described herein above, the method according to the present invention allows by applying non-preheat rolling the production of magnesium alloy sheets having an excellent bendability. Especially, it becomes possible to manufacture such magnesium alloy sheets having an excellent bendability by merely adding the non-preheat rolling to the prior art rolling process.

Improved bendability of magnesium alloy sheets allows: (1) lowered mold temperature in press forming; (2) increased working rate or speed (strain rate), contributing to improvement in the working productivity of press forming process as a whole.

Also, application of a lubricant to the alloy sheet surface before rolling allows the improvement in its bendability and thus in its workability in press forming.

By combining the non-preheat rolling with suitable heat treatment conditions, it becomes possible to manufacture magnesium alloy sheets having an excellent bendability and thus to improve significantly the working productivity in press forming process of the magnesium alloy sheets.

It is expected that the magnesium alloy sheets according to the present invention find a wide range of applications such as housings of personal computers, cellular phones and other products targeting lighter weights and/or requiring strength as well as toughness.

What is claimed is:

1. A method of manufacturing a magnesium alloy sheet, comprising rolling a magnesium alloy sheet through a reduction roll, the alloy thereof containing about 0.1-10.0 mass % of Al and about 0.1-4.0 mass % of Zn, wherein:

said magnesium alloy sheet has a surface temperature of about 100° C. or below at the time just before it is fed in the reduction roll; and said reduction roll has a surface temperature in the range of about 100° C. to 300° C.

2. A method of manufacturing a magnesium alloy sheet according to claim 1 above, wherein said magnesium alloy sheet is subjected to solution treatment at about 350-450° C. for 1 hour or longer before said rolling.

3. A method of manufacturing a magnesium alloy sheet according to claim 1 above, wherein said magnesium sheet alloy is subjected to heat treatment at about 100-350° C. after said rolling.

4. A method of manufacturing a magnesium alloy sheet according to claim 1 above, wherein said rolling is performed at a rolling speed of about 1.0 m/min. or above.

5. A method of manufacturing a magnesium alloy sheet according to claim 1 above, wherein said rolling is performed using a lubricant.

6. A method of manufacturing a magnesium alloy sheet according to claim 1, wherein said rolling is executed in multipass mode and at least the last one pass thereof is executed by using specified temperatures as said surface temperatures of said magnesium alloy sheet and of said reduction roll, respectively.

7. A method of manufacturing a magnesium alloy sheet according to claim 1 above, wherein said rolling is accomplished with a total rolling reduction of about 5.0-30.0%.

8. A magnesium alloy sheet, comprising about 0.1-10.0 mass % of Al and about 0.1-4.0 mass % of Zn, wherein:

said magnesium alloy sheet has a minimum bending modulus B of about 2 or smaller given by the following formula, where r is a minimum bend radius of a punch that permits a test specimen to be bent without undergoing surface cracking in a bending test:

$B=r/t$ ($r$=minimum bend radius and $t$=sheet thickness, in mm).

9. A magnesium alloy sheet according to claim 8 above, wherein said alloy sheet has a tensile strength of about 250 $N/mm^2$ or above and an elongation of about 15% or above.

10. A magnesium alloy sheet, comprising about 0.1-10.0 mass % of Al and about 0.1-4.0 mass % of Zn, wherein:

said magnesium alloy sheet has a plastic strain ratio $r_{90}$-value of about 2.0 or less in a tensile direction perpendicular to the rolling direction; and said magnesium alloy sheet satisfies at least one of the following requirements: an elongation being 10% or above in said tensile direction; or a ratio $I_{(002)}/I_{(101)}$ being smaller than about 10, with the $I_{(002)}/I_{(101)}$ being a ratio of diffraction intensities $I_{(002)}$ in (002) plane vs. $I_{(101)}$ in (101) plane as observed in X-ray diffractometry.

11. A magnesium alloy sheet according to claim 10 above, wherein said plastic strain ratio $r_0$ value in a tensile direction parallel to the rolling direction is about 1.2 or below.

12. A magnesium alloy sheet according to claim 10 above, wherein said magnesium alloy sheet has an average grain size of about 10 μm or below.

13. A magnesium alloy sheet according to claim 10 above, wherein said magnesium alloy sheet has a minimum bending modulus B of about 2 or smaller given by the following formula, where r is a minimum bend radius of a punch that permits a test specimen to be bent without undergoing surface cracking in a bending test:

$B=r/t$ ($r$=minimum bend radius and $t$=sheet thickness, in mm).

* * * * *